United States Patent [19]

Sauer et al.

[11] 4,449,429

[45] May 22, 1984

[54] POWER TOOL FOR TENSIONING HOSE CLAMPS AND THE LIKE

[75] Inventors: Heinz Sauer, Ronneburg; Willi Stichel, Maintal; Gerhard Wachter, Büdingen, all of Fed. Rep. of Germany

[73] Assignee: Rasmussen GmbH, Maintal, Fed. Rep. of Germany

[21] Appl. No.: 394,654

[22] Filed: Jul. 2, 1982

[30] Foreign Application Priority Data

Jul. 6, 1981 [DE] Fed. Rep. of Germany ..... 3126632

[51] Int. Cl.[3] ..... B25B 25/00

[52] U.S. Cl. ..... 81/9.3; 81/9.1 M; 140/93.2; 100/32; 254/228

[58] Field of Search ..... 81/9.3, 9.1 M, 9.1 R; 100/29, 30, 32; 140/93.2, 93.4; 254/228; 24/68 D, 69 ST, 69 TM

[56] References Cited

U.S. PATENT DOCUMENTS 2,729,994 1/1956 Hewitt et al. ..... 81/9.3

3,254,680 6/1966 Caveney et al. ..... 81/9.3

FOREIGN PATENT DOCUMENTS 42786 12/1981 European Pat. Off. ..... 81/9.3

*Primary Examiner*—Roscoe V. Parker

*Attorney, Agent, or Firm*—Peter K. Kontler

[57] ABSTRACT

A power tool for tensioning hose clamps of the type wherein one end portion of a strap overlies the other end portion and has a laterally extending tip which can break away or bend in response to the application of a pull sufficient to effect satisfactory tensioning of the looped central portion of the strap around a hose or the like. The tool has a barrel with an inlet receiving the one end portion so that the tip can be engaged by the shoulder of an entraining element mounted at the front end of a retractible piston rod. The tensioning element is reciprocable in and relative to a bearing which is reciprocable in the barrel by interposition of friction reducing rolling elements. When the piston rod is retracted, the shoulder of the tensioning element moves against the tip of the one end portion of the strap and exerts a pull upon the tip while moving with the bearing so that the force which is needed to bend or break the tip at least approximates the maximum force that is necessary to retract the piston rod. Upon flexing or breakage of the tip, the bearing and the tensioning element reassume predetermined starting positions in which they are ready for the next tensioning operation.

17 Claims, 8 Drawing Figures

A
A
P

POWER TOOL FOR TENSIONING HOSE CLAMPS AND THE LIKE

BACKGROUND OF THE INVENTION

The present invention relates to tools for tensioning hose clamps or the like, especially for tensioning hose clamps of the type wherein the tightening or tensioning means does not constitute or include screws or analogous threaded components. A clamp which can be tensioned by the tool of the present invention (e.g., to sealingly engage the end of a flexible hose with a nipple which extends into the hose) comprises a strap having two overlapping end portions and defining a loop which surrounds a hose or another workpiece when the clamp is applied. In order to tension the clamp, one end portion of the strap is pulled to reduce the size of the loop while the other end portion is held against movement in response to the application of a pull to the one end portion. The end portions have mating teeth or analogous projections which prevent expansion or enlargement of the loop. Clamps which can be tensioned with the tool of the present invention are disclosed, for example, in commonly owned copending U.S. patent application Ser. No. 258,375 filed Apr. 28, 1981 by Heinz Sauer et al. for "Clamp for hoses or the like". In the clamp which is disclosed in the U.S. patent application Ser. No. 258,375, the free end or tip of the one end portion of the strap is bent over so as to be engageable by a tool which pulls the one end portion. The other end portion of the strap has an external protuberance against which a portion of the tensioning tool abuts in order to prevent the other end portion from sharing the movement of the one end portion during tensioning of the clamp, i.e., during a reduction of the size of the loop. The tip of the one end portion yields and is bent back into the general plane of the one end portion when the magnitude of the tensioning force reaches a maximum permissible value.

It is already known to employ power tools for the purpose of tightening a hose clamp in the above outlined manner. A known tightening or tensioning tool has a tubular member with an inlet for admission of the one end portion of the strap. The tool further comprises a tensioning element which is installed in the interior of the tubular member and can engage the tip of the inserted one end portion. The tensioning element is movable by the piston rod of a fluid-operated motor to exert a pull on the one end portion of the strap (through the medium of the bentover tip of such end portion). The piston rod can be returned to its normal position (in which the tensioning element is ready to engage the tip of the one end portion of a strap) by a suitable restoring spring. When the tool is in actual use, the tip of the one end portion of the strap is engaged by the tensioning element while the latter is caused to move deeper into the tubular guide whereby the size of the loop is reduced, i.e., the strap is pulled tight around a deformable hose or a like workpiece. The tensioning element urges the one end portion against the inner side of the tubular guide so that it slides along the guide while the size of the loop decreases. This generates a substantial amount of friction between the one end portion of the strap and the internal surface of the guide, and such friction must be overcome by the tool (i.e., the force with which the tensioning element is drawn deeper into the interior of the guide must overcome the resistance of the workpiece to compression, the resistance of the strap to a reduction of the size of its loop as well as the frictional forces which develop between the one end portion of the strap and the tubular guide. This, in turn, entails premature bending of the tip of the one end portion, i.e., the tip yields and is flexed back into the general plane of the one end portion ahead of the time when the dimensions of the loop are reduced to an optimum value. Otherwise stated, friction between the one end portion of the strap and the tubular guide for the tensioning element prevents the bent-over tip of the one end portion from yielding only at such time when the end portion of a hose or a similar workpiece is adequately compressed to prevent leakage of pressurized fluid in an automotive vehicle or elsewhere where hose clamps or analogous devices are used to sealingly connect hoses, pipes, tubes, nipples or analogous workpieces to each other. This, in turn reduces the reliability of connections which are established by resorting to tensioned hose clamps.

OBJECTS AND SUMMARY OF THE INVENTION

An object of the invention is to provide a tensioning tool which is constructed and assembled in such a way that the tip of the one end portion of the strap of a hose clamp is flexed or breaks away only when the strap has undergone the desired tensioning action.

Another object of the invention is to provide a tool of the above outlined character which is simple and compact, whose energy requirements are lower than those of a conventional tool, and which can be readily manipulated by semiskilled or even unskilled persons.

A further object of the invention is to provide a power tool which is designed in such a way that the tip of the one end portion of the strap is flexed back into the general plane of the one end portion or breaks away only when the size of the loop is reduced sufficiently to ensure the establishment of a satisfactory sealing action between two workpieces, such as between the end portion of a hose and a nipple which extends into the hose.

An additional object of the invention is to provide a power tool which ensures that the tip of the one end portion of the strap yields (e.g., by bending back into the general plane of the one end portion or by breaking away) only and alone when the desired tensioning action is already achieved.

A further object of the invention is to provide a novel and improved method of tensioning hose clamps or the like.

Another object of the invention is to provide the power tool with novel and improved means for engaging the tip of the one end portion and the protuberance of the other end portion preparatory to and during tensioning of the clamp.

A further object of the invention is to provide novel and improved means for facilitating insertion of the one end portion of the strap into the power tool and for reducing the likelihood of pronounced or excessive friction between stationary and moving parts or between parts which move at different speeds while the tool is actuated to reduce the size of the loop defined by a strap which forms part of the hose clamp.

The invention resides in the provision of a tool (preferably a power tool) for tensioning a hose clamp or a like device wherein a strap of flexible material defines a loop and has two end portions one of which has a laterally extending projection and wherein the exertion of a pull upon the projection entails a reduction of the size of the loop. The tool comprises a tubular barrel which is provided with an inlet for insertion of the one end portion of a strap, a tensioning element which is reciprocably received in the barrel and has a shoulder or an analogous entraining portion engageable with the projection of the inserted one end portion, a bearing which is interposed between the tensioning element and the barrel and is reciprocable in the barrel with a small amount of friction, and a piston rod or other suitable means for moving the tensioning element (and the bearing through the medium of the tensioning element) relative to the barrel in a direction to exert a pull upon the projection of the inserted one end portion. The aforementioned piston rod extends through the bearing with at least some clearance and can be made rigid with the tensioning element. For example, the front end of the piston rod can be separably secured to the tensioning element by a screw or other suitable fastener means.

The tensioning element can be provided with a collar or other suitable means for advancing the bearing in the aforementioned direction (so that the entraining portion of the tensioning element exerts a pull upon the one end portion of the strap through the medium of the projection), and the tensioning element is also movable relative to the bearing in the opposite direction. Biasing means (such as a coil spring or another suitable spring) can be provided to yieldably urge the bearing in the opposite direction.

The barrel can be provided with a closure which can constitute a means for normally maintaining the tensioning element in a first predetermined position, and with means (such as an internal shoulder of an abutment which is separably secured to the front end of the barrel) for normally maintaining the bearing in a second predetermined position in which the advancing means of the tensioning element is spaced apart from the bearing by a first distance and the entraining portion of the tensioning element is spaced apart from the bearing by a second distance which is less than the first distance.

Friction reducing means (e.g., rolling elements in the form of needles) can be interposed between the barrel and the bearing to thus keep the friction to a minimum. The bearing can be provided with sockets (e.g., with flutes which extend substantially transversely of the barrel) for portions of the rolling elements.

The aforementioned internal shoulder of the abutment can constitute a stop which limits further forward movement of the bearing under the action of the biasing means whereby the bearing is held in the aforementioned second predetermined position.

The barrel and the bearing on the one hand, and the bearing and the tensioning element on the other hand, can be provided with means for respectively holding the bearing against rotation in the barrel and the tensioning element against rotation in the bearing. This can be achieved, in accordance with a presently preferred embodiment of the invention, by imparting to the barrel a polygonal (e.g., square or rectangular) internal cross-sectional outline, by imparting to the bearing a polygonal internal and external cross-sectional outline, and by imparting to the exterior of the tensioning element a polygonal cross-sectional outline. The neighboring surfaces of the bearing, barrel and tensioning element then hold the tensioning element against rotation in the bearing and the bearing against rotation in the barrel.

The novel features which are considered as characteristic of the invention are set forth in particular in the appended claims. The improved tool itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3, 4, 5, 6, 7, 8:
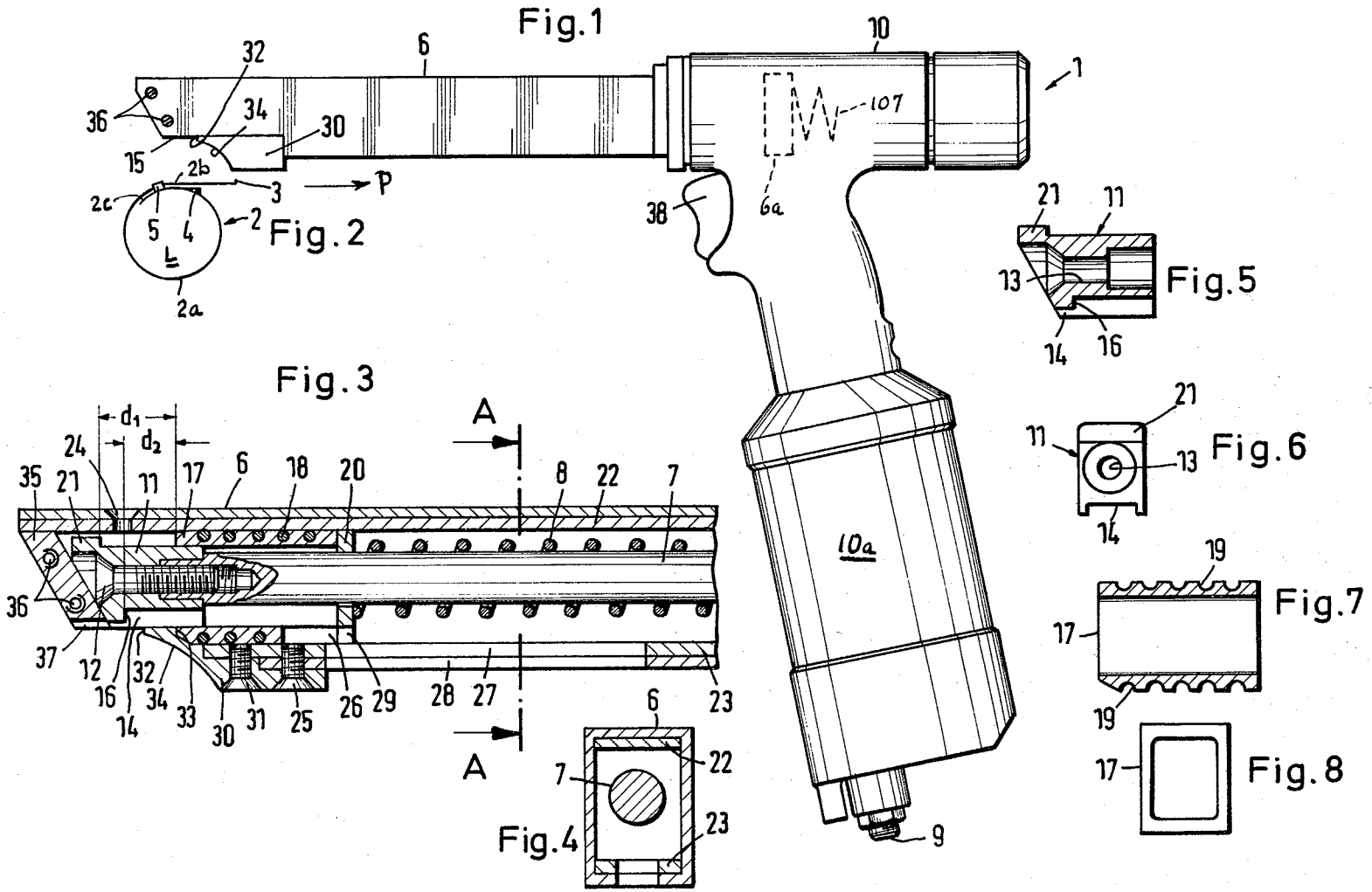
FIG. 1 is a side elevational view of a power tool which embodies the invention.
FIG. 2 is an elevational view of a hose clamp whose strap is ready to be tightened by the power tool of FIG. 1.
FIG. 3 is an enlarged longitudinal vertical sectional view of the working end of the power tool shown in FIG. 1.
FIG. 4 is a transverse sectional view as seen in the direction of arrows from the line A—A of FIG. 3.
FIG. 5 is an axial sectional view of a tensioning element in the structure which is shown in FIG. 3.
FIG. 6 is a front end view of the tensioning element which is shown in FIG. 5.
FIG. 7 is an axial sectional view of a bearing for the tensioning element of FIGS. 5 and 6.
FIG. 8 is a front end view of the bearing which is shown in FIG. 7.

The power tool 1 which is shown in FIG. 1 resembles a gun and is actuated by a pressurized fluid, preferably by compressed air. The purpose of the tool 1 is to tension a hose clamp 2 of the type shown in FIG. 2 and preferably resembling hose clamps which are disclosed in the aforementioned commonly owned copending U.S. patent application Ser. No. 258,375 of Heinz Sauer et al. For the sake of convenience, the disclosure of the U.S. patent application Ser. No. 258,375 is incorporated herein by reference.

FIG. 2 shows the clamp 2 in untensioned condition. The two end portions **2*b*, 2*c* of the elongated flexible strap 2*a* of the clamp 2 overlap each other and the major part of the strap 2*a* forms a substantially circular loop L. The end portion 2*b* extends through an eyelet or guide 5 which is provided on the end portion 2*c*, and the free end or tip 3 of the end portion 2*b* constitutes an upturned projection which is flexed into the general plane of the end portion 2*b* or which breaks away when the tensioning operation is completed, i.e., when the tensioning force suffices to overcome the resistance of the material of the strap 2*a* to flexing in the region where the bent-over projection or tip 3 merges into the adjacent part of the end portion 2*b*. The end portion 2*c* has an external protuberance 4 whose purpose will be described hereinafter. Furthermore, the end portions 2*b* and 2*c* are formed with mating teeth (not specifically shown) which prevent the clamp 2 from expanding once the size of the loop L is reduced in response to exertion of a pull (arrow P) upon the tip 3 while the protuberance 4 is held against movement in the same direction. The clamp 2 which is shown in FIG. 2** is of the type wherein the size of the loop L need not be reduced by resorting to a screw, bolt or an analogous threaded member. Clamps with tightening screws are disclosed, for example, in commonly owned U.S. Pat. No. 4,244,088 granted Jan. 13, 1981 to Heinz Sauer for "Hose Clip" and in commonly owned U.S. Pat. No.

4,300,270 granted Nov. 17, 1981 to Heinz Sauer for "Housing for tightening elements of hose clips".

Hose clamps of the type shown in the patents to Sauer and in the copending U.S. patent application Ser. No. 258,375 of Sauer et al. can be used, for example, in the automotive industry to secure end portions of flexible hoses to nipples or the like as well as for analogous purposes in many other industries. The end portion 2b extends substantially tangentially of the circular central portion or loop L of the strap 2a and its tip 3 is spaced apart from the protuberance 4, as considered in the longitudinal direction of the end portion 2b. The eyelet 5 not only guides the end portion 2b relative to the end portion 2c during tensioning of the clamp 2, i.e., during a reduction of the size of the substantially circular loop L defined by the strap 2a, but it can also serve as a means for preventing disengagement of teeth on the end portion 2b from the adjacent teeth on the end portion 2c, i.e., the size of the loop L can be reduced but it cannot be readily enlarged.

As can be seen in FIGS. 3 and 4, the power tool 1 has an elongated polygonal tubular barrel or guide 6 which constitutes or can constitute a cylinder for a piston 6a (indicated by broken lines) disposed within the confines of a housing 10 forming part of the tool 1 and disposed at a level above a handgrip portion or handle 10a. The lower part of the handgrip portion 10a is provided with a nipple 9 for connection to a conduit (e.g., a flexible hose, not shown) which, in turn, is connected to a source of compressed gaseous fluid, preferably air. The piston 6a is disposed at the rear end of an elongated piston rod 7 which is biased forwardly (in a direction to the left, as viewed in FIG. 3) by a helical return spring 8 bearing against a ring-shaped motion transmitting member 20 in the barrel 6 and reacting against a suitable retainer (not shown) in the housing 10. When the operator depresses the trigger 38 or an analogous actuating element, compressed air is free to act against the left-hand side of the piston 6a and to retract the piston rod 7 against the opposition of the spring 8, i.e., to move the piston rod 7 in a direction to the right, as viewed in FIG. 3.

The free end portion of the piston rod 7 carries or constitutes a tensioning element 11. In the illustrated embodiment, the tensioning element 11 is a discrete component which is separably secured to the front end portion of the piston rod 7 by a screw 12 or an analogous fastener. The shank of the screw 12 extends through an axial bore 13 (see FIG. 5) of the tensioning element 11 and extends into a tapped bore (see FIG. 3) in the front end face of the piston rod 7. The bore 13 has a forwardly and outwardly tapering front portion for the head of the screw 12 and a larger-diameter rear portion which receives the front end portion of the piston rod 7. This can be seen in FIG. 5. It is equally within the purview of the invention to provide the front end portion of the piston rod 7 with external threads mating with internal threads which are machined into the rear portion of the tensioning element 11. A bayonet lock connection can be provided between the parts 7, 11 or (and as already stated above) these parts can constitute a one-piece component of the power tool 1.

The underside of the tensioning element 11 (as viewed in FIG. 3, 5 or 6) has a longitudinally extending groove or recess 14 the right-hand portion of which is deeper than the left-hand portion so that the two portions of the groove 14 define a shoulder 16 serving as a means for entraining the tip 3 of the end portion 2b of a clamp 2 when the power tool 1 is in actual use and the piston rod 7 is caused to move in a direction to the right, as viewed in FIG. 3. The open underside of the groove 14 faces a slit-shaped inlet 15 (note FIG. 1) provided in the front end portion and at the underside of the barrel 6. The inlet 15 and the groove 14 provide room for insertion of the tangentially extending end portion 2b of the strap 2a so that the shoulder 16 can engage the tip 3. The shoulder 16 which is shown in FIGS. 3 and 5 extends substantially radially of the piston rod 7; however, its inclination can be increased so as to slope downwardly and to the right, as viewed in FIG. 5. When the end portion 2b of the strap 2a shown in FIG. 2 is properly inserted into the barrel 6 so that it extends into the groove 14 at the underside of the tensioning element 11, the shoulder 16 engages the left-hand side of the upstanding tip 3.

The tensioning element 11 is reciprocable in a tubular bearing 17 (note FIGS. 3, 7 and 8) which has a polygonal cross-sectional outline and spacedly surrounds the adjacent portion of the piston rod 7. The bearing 17 is reciprocable in the barrel 6 of the power tool 1. The arrangement is preferably such that the power tool 1 comprises antifriction rolling elements 18 (e.g., in the form of needles) which are interposed between the internal surface of the barrel 6 and the external surface of the bearing 17. In the illustrated embodiment, the upper and lower walls of the bearing 17 are formed with transversely extending sockets in the form of flutes 19 (see FIG. 7) for portions of the rolling elements 18. The depth of the flutes 19 can be selected in such a way that only a small portion of each rolling element 18 extends beyond the respective external surface of the bearing 17. Rolling elements in the form of spheres or rollers can be used with equal or nearly equal advantage.

The bearing 17 is disposed between the aforementioned motion transmitting member 20 (which is engaged by the foremost convolution of the spring 8) and an advancing flange or collar 21 at the front end of the tensioning element 11. The distance $d_1$ between the collar 21 and the front end face of the bearing 17 (in retracted position of the piston rod 7 and while the rear end face of the bearing 17 abuts against the front side or face of the motion transmitting member 20) exceeds the distance $d_2$ between the front end face of the bearing 17 and the shoulder 16 in the groove 14 of the tensioning element 11.

The motion transmitting member 20 is also reciprocable in the barrel 6. The opening in this member is preferably large enough to receive the piston rod 7 with at least some clearance. The upper and lower end faces of the member 20 are slidable along the inner sides of strip-shaped liners 22 and 23 which cover the respective parts of the internal surface of the barrel 6. The upper liner 22 is secured to the respective wall of the barrel 6 by one or more screws 24, and the lower liner 23 is secured to the respective wall of the barrel 6 by one or more screws 25.

The bearing 17 has a longitudinally extending slot 26 which is provided in the bottom wall of the bearing and is open at its rear end. The lower liner 23 has an elongated slot 27, and the lower wall of the barrel 6 has a further slot 28. A motion transmitting member 20 is formed with a groove or recess 29 which extends all the way between its front and rear sides. The slots 27 and 28 are closed at their front and rear ends, and their width preferably matches that of the groove 29 and slot 26.

The slots 26, 27, 28 and the grooves 14, 29 are in register with one another.

The front portion of the barrel 6 carries an abutment 30 which is secured thereto by at least one of the aforementioned screws 25 for the liner 23 as well as by an additional screw 31. The upper side of the abutment 30 partially overlaps the inlet 15 for the tangentially extending end portion **2*b* of the strap 2*a*. The front end face 32 of the abutment 30 constitutes a shoulder which can be placed into contact with the protuberance 4 on the end portion 2*c* of the strap 2*a*. Still further, the abutment 30 has an internal surface or stop shoulder 33 which can serve as a means for maintaining the left-hand end face of the bearing 17 in a predetermined position. A concave external surface 34 of the abutment 30 serves to contact the outer side of the strap 2*a* to the right of the protuberance 4 on the end portion 2*c*. It is preferred to select the curvature of the surface 34 in such a way that it at least approximates the initial or final curvature of the clamp 2**.

The front end of the barrel 6 contains a closure 35 which is separably secured thereto by screws 36 or analogous fastener means. The underside of the closure 35 has a longitudinally extending open-ended groove or recess 37 which registers with the groove 14 at the underside of the tensioning element 11 and whose width preferably matches that of the groove 14.

The dimensions of the parts shown in FIGS. 3 and 4 can match or approximate the dimensions of the tool 1 as actually built.

The operation of the power tool 1 is as follows:

In order to tension the illustrated hose clamp 2 around the end portion of a hose, not shown, which in turn surrounds a nipple (e.g., under the hood of an automotive vehicle), the clamp 2 is placed around the end portion of the hose before the size of the loop L defined by the strap **2*a* is reduced to a value which could present problems in connection with application of the strap around the hose. The end portion 2*b* which extends substantially tangentially of the loop L is inserted into the groove 14 of the tensioning element 11 and all the way into the interior of the bearing 17 so that the protuberance 4 of the end portion 2*c* comes into contact with the shoulder 32 of the abutment 30. This causes the outer side of the loop L adjacent to the protuberance 4 to move into contact with the concave surface 34 of the abutment 30. The difference between the distances $d_1$ and $d_2$ is selected in such a way that it is somewhat less than or that it equals the distance between the tip 3 of the end portion 2*b* (while the protuberance 4 abuts against the shoulder 32) and the left-hand end face of the bearing 17 (as viewed in FIG. 3**).

In the next step, the operator of the tool 1 depresses the trigger 38 to retract the piston rod 7 toward the housing 10 against the opposition of the restoring spring 8. Thus, the piston **6*a* moves in a direction to the right, as viewed in FIG. 1, and entrains the piston rod 7 as well as the tensioning element 11 in the same direction against the opposition of a spring 107 in the housing 10. The collar 21 of the tensioning element 11 moves toward and engages the left-hand end face of the bearing 17 so that the latter begins to share the rightward movement of the piston rod 7 against the opposition of the restoring spring 8. Shortly thereafter, the shoulder 16 in the groove 14 of the tensioning element 11 engages and entrains the tip 3 of the end portion 2*b*, i.e., the end portion 2*b* begins to move gradually relative to the end portion 2*c* and the size of the loop L which is defined by the strap 2*a* of the clamp 2 decreases. The end portion 2*c* is held against any movement relative to the barrel 6 because its protuberance 4 engages the shoulder 32 at the front end of the abutment 30. The frictional force which resists the movement of the bearing 17 with the tensioning element 11, i.e., which resists the movement of the bearing 17 with the piston rod 7, is small or negligible because of the provision of rolling elements 18 between the bearing 17 and the liners 22, 23 or for the barrel 6. Thus, the tensioning force which is supplied by the piston rod 7 is transmitted, practically without losses, to the end portion 2*b* of the strap 2*a*. As the size of the loop L decreases, i.e., as the extent of displacement of the end portion 2*b* of the strap 2*a* into the interior of the barrel 6 increases, the tensioning of the clamp 2 finally reaches a value at which the tip 3 yields (either by bending back into the general plane of the end portion 2*b* or by breaking away), i.e., the resistance of the tip 3 to movement relative to the remaining part of the end portion 2*b* is overcome and the shoulder 16 is free to move the tip 3 to a position in which the application of tensional stress to the strap 2*a* is terminated. If the tip 3 is merely flexible but, as a rule, does not break away from the remainder of the end portion 2*b* when the tensioning force reaches the desired value, the tip 3 is flexed against the inner side of the bottom wall of the bearing 17 and the tensioning element 11 can slide over the thus deflected or reoriented tip 3 in a direction to the right, as viewed in FIG. 3**.

The operator can readily sense that the tip 3 has yielded, and the operator then releases the trigger 38 so that the spring 8 is free to return the parts 17 and 20 to the positions shown in FIG. 3. To this end, the spring 8 bears against the motion transmitting member 20 which pushes the bearing 17 back into engagement of its front end face with the internal shoulder 33 of the abutment 30. This terminates the forward movement of the bearing 17 and of the motion transmitting member 20. The piston rod 7 can continue to move forwardly under the action of the spring 107 which thus returns the piston rod and the tensioning element 11 to the predetermined positions shown in FIG. 3, i.e., to return the tensioning element 11 into contact with the inner side of the cover 35. The initial stage of return movement of the tensioning element 11 is assisted by the bearing 17 which abuts against the collar 21 of the element 11 while moving under the action of the motion transmitting member 20. The spring 107 can be omitted if the pressure of fluid at the right-hand side of the piston **106*a* is high enough to permanently urge the piston rod 7 and the tensioning element 11 to the positions shown in FIG. 3**.

An important advantage of the improved power tool is that the tensioning element 11 is readily reciprocable in the bearing 17 (i.e., with a minimum of friction) and that the bearing 17 is readily reciprocable in the barrel 6. In fact, friction between the bearing 17 and the liners 22, 23 is minimal or negligible. The bearing 17 surrounds the piston rod 7 with sufficient clearance to avoid the generation of friction while the piston rod 7 moves relative to the bearing (during the initial stage of a tensioning operation when the collar 21 moves toward the front end face of the bearing 17).

Another advantage of the improved power tool is that the distance $d_1$ exceeds the distance $d_2$ and that the bearing 17 is installed with clearance between the collar 21 of the tensioning element 11 and the motion transmitting member 20 (i.e., the foremost convolution of the restoring spring 8) when the piston rod 7 is held in the fully extended position of FIG. 3. This ensures that, prior to begin of a tensioning operation, the tip 3 of the end portion 2*b* can extend all the way into the interior of the bearing 17. Consequently, the initial stage of tensioning of the strap 2*a* is preceded by a movement of the tensioning element 11 relative to the bearing 17 (until the collar 21 reaches the front end face of the bearing). This is followed by advancement of the shoulder 16 into engagement with the still undeformed tip 3 of the end portion 2*b* so that, from then on, the tip 3, the tensioning element 11 and the bearing 17 share (as a unit) the rearward or inward movement of the piston rod 7. Therefore, and since the tensioning element 11 moves relative to the bearing 17 only at such time when its shoulder 16 is still out of contact with the tip 3, friction between the barrel 6 and the unit including the parts 11, 17 and 20 is negligible owing to the provision of rolling elements 18 or analogous friction-reducing or eliminating means. The tip 3 or any other part of the end portion 2*b* cannot move into frictional engagement with the stationary barrel 6 and/or its liners 22, 23 so that the magnitude of the force with which the piston rod 7 is pulled against the opposition of the restoring spring 8 can be said to practically match the desired tensioning force. The collar 21 of the tensioning element 11 ensures that the bearing 17 shares the movement of the piston rod 7 during that stage of movement of the piston rod when the shoulder 16 of the element 11 is in engagement with and pulls the tip 3 deeper into the interior of the barrel 6. Separation of the parts 11 and 17 from the end portion 2*b* upon flexing or breakage of the tip 3 presents no problems. As mentioned above, the tip 3 is bent into the general plane of the end portion 2*b* or is broken away so that it can drop out through the slot 26, groove 29 and slots 27, 28.

It has been found that the provision of needles 18 or analogous rolling element 18 is particularly advantageous as concerns the reduction of friction between the bearing 17 and the barrel 6. The utilization of needle-like rolling elements is of advantage on the additional ground that their diameters can be kept to a minimum. This contributes to a reduction of transverse dimensions of the barrel 6. As a rule, the diameters of needle-like or analogous rolling elements can be a small fraction of the diameters of spherical rolling elements. Small-diameter needle-like rolling elements can be used with advantage because their area of contact with the bearing 17 and with the liners 22, 23 is much greater than if they were replaced with spherical or analogous rolling elements. By providing the bearing 17 with flutes 19 for the needle-like rolling elements 18, one avoids the need for a cage which would confine the folling elements in the spaces between the top and bottom walls of the bearing 17 on the one hand and the liners 22, 23 on the other hand.

The provision of a fixed stop shoulder (33) for the front end face of the bearing 17 is desirable and advantageous because this ensures that the spring 8 can invariably return the bearing to one and the same predetermined starting position when the depression or actuation of the trigger 38 is terminated.

While it is also possible to employ a cylindrical bearing and a cylindrical barrel, the provision of a polygonal bearing and a polygonal barrel (in conjunction with a polygonal tensioning element) is desirable and advantageous because this ensures that the angular position of the shoulder 16 cannot change, i.e., such shoulder is always in an optimum position for engagement with the tip 3 of a properly inserted end portion 2*b*. The same holds true for the orientation of the inlet 15 and groove 14. Also, the groove 14 is invariably in register with the groove 29 and with the slots 26, 27 and 28.

A further important advantage of the improved power tool is that the tensioning element 11 is readily accessible and detachable for the purpose of inspection, cleaning or replacement. For example, it can happen that the operator will wish to replace the illustrated tensioning element 11 with an element whereon the width of the shoulder 16 on the element 11 is less than in the illustrated embodiment in order to change the magnitude of that tensioning force which suffices to cause the tip 3 of an end portion to yield and to move into the general plane of such end portion or to break away from the remainder of the strap. This will be readily appreciated by bearing in mind that, if the width of the shoulder 16 (as considered radially of the piston rod 7) is less than the width of the tip 3, the radial lever arm which causes the shoulder 16 to flex the tip 3 is greater than if the width of the shoulder 16 matches that of the tip 3. Thus, a lesser force is needed to bend or break the tip 3 if the width of the shoulder 16 is reduced (it being assumed that, in both instances, the resistance of the tip 3 to bending or breakage is the same).

All that is necessary to gain access to the illustrated tensioning element 11 is to remove the screws 36 (i.e., to remove the cover or end wall 35) and to thereupon remove the screw 12 preparatory to detachment of the element 11 from the front end portion of the piston rod 7. The inner side of the cover 35 maintains the tensioning element 11 in a predetermined starting position in which the distance $d_1$ exceeds the distance $d_2$ (when the bearing 17 engages the internal shoulder 33 of the abutment 30).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A tool for tensioning a hose clamp or a like device wherein a strap of flexible material defines a loop and has two end portions one of which has a laterally extending projection and wherein the exertion of a pull upon the projection entails a reduction of the size of the loop, comprising a tubular barrel provided with an inlet for insertion of the one end portion of a strap; a tensioning element reciprocably received in said barrel and having an entraining portion engageable with the projection of the inserted one end portion; a bearing interposed between said element and said barrel and reciprocable in the latter with a small amount of friction; and means for moving said element, and said bearing through the medium of said element, relative to said barrel in a direction to exert a pull upon the projection of the inserted one end portion.

2. The tool of claim 1, wherein said moving means comprises a piston rod which extends through said bearing with at least some clearance and is rigid with said tensioning element.

3. The tool of claim 1, wherein said tensioning element includes means for advancing said bearing in said direction and said element is movable relative to said bearing in the opposite direction.

4. The tool of claim 3, further comprising means for yieldably urging said bearing in said opposite direction.

5. The tool of claim 3, further comprising means for normally maintaining said element in a first predetermined position and for normally maintaining said bearing in a second predetermined position in which said advancing means is spaced apart from said bearing by a first distance and said entraining portion is spaced apart from said bearing by a second distance which is less than said first distance.

6. The tool of claim 1, further comprising friction reducing means interposed between said bearing and said barrel.

7. The tool of claim 6, wherein said friction reducing means comprises rolling elements.

8. The tool of claim 7, wherein at least some of said rolling elements are needles.

9. The tool of claim 7, wherein said bearing has sockets for said rolling elements.

10. The tool of claim 9, wherein said sockets include flutes extending substantially transversely of said barrel.

11. The tool of claim 1, further comprising means for biasing said bearing counter to said direction, and stop means on said barrel for arresting said bearing in a predetermined position against further movement under the action of said biasing means.

12. The tool of claim 1, wherein said barrel and said bearing comprise means for holding said bearing against rotation in the barrel.

13. The tool of claim 12, wherein said bearing and said tensioning element comprise means for holding said element against rotation in the bearing.

14. The tool of claim 13, wherein said barrel has a polygonal internal cross-sectional outline and said bearing has a polygonal external cross-sectional outline.

15. The tool of claim 13, wherein said bearing has a polygonal internal cross-sectional outline and said tensioning element has a polygonal external cross-sectional outline.

16. The tool of claim 1, further comprising means for separably securing said tensioning element to said moving means.

17. The tool of claim 16, wherein said moving means comprises an elongated rod having a front end and said tensioning element is separably secured to the front end of said rod.

* * * * *